US005664380A

United States Patent [19]

Hsueh

[11] Patent Number: 5,664,380

[45] Date of Patent: Sep. 9, 1997

[54] PARTITION FRAME STRUCTURE

[76] Inventor: Jen Shiung Hsueh, No. 2-1, Lane 59, Ming Shiang Street, Chung Ho City, Taipei Hsien, Taiwan

[21] Appl. No.: 501,399

[22] Filed: Jul. 12, 1995

[51] Int. Cl.[6] ..... E04B 2/78

[52] U.S. Cl. ..... 52/126.4; 52/653.1; 52/731.5; 52/731.9; 52/481.2; 52/483.1; 52/775; 52/781; 211/184

[58] Field of Search ..... 52/126.4, 653.1, 52/220.7, 220.8, 238.1, 731.4, 731.5, 731.8, 731.9, 653.2, 654.1, 481.2, 483.1, 489.1, 489.2, 775, 781, 781.3, 126.3, 239, 241, 242, 243.1, 36.5, 36.6; 211/183, 184, 187, 189, 190, 191

[56] References Cited

U.S. PATENT DOCUMENTS

| | | | |
|---|---|---|---|
| 570,657 | 11/1896 | Beckwith | 211/184 X |
| 2,081,368 | 5/1937 | Pretot | 52/489.1 |
| 3,293,813 | 12/1966 | Emmons et al. | 52/238.1 |
| 3,305,981 | 2/1967 | Biggs et al. | 52/731.5 X |
| 3,312,025 | 4/1967 | Deakins | 52/239 |
| 3,343,318 | 9/1967 | Birum, Jr. | 52/239 |
| 3,394,507 | 7/1968 | Doke | 52/36.6 |
| 3,537,217 | 11/1970 | Lickliter et al. | 52/126.4 |
| 3,778,939 | 12/1973 | Nelsson | 52/36.6 |
| 3,940,900 | 3/1976 | Russo | 52/238.1 X |
| 4,581,859 | 4/1986 | Doke et al. | 52/238.1 X |
| 4,667,450 | 5/1987 | Stefnik et al. | 52/238.1 |
| 5,060,434 | 10/1991 | Allison | 52/481.2 X |
| 5,069,263 | 12/1991 | Edwards | 52/239 X |
| 5,187,908 | 2/1993 | Losensky | 52/769 X |
| 5,285,602 | 2/1994 | Felton | 52/36.5 X |
| 5,406,760 | 4/1995 | Edwards | 52/239 |
| 5,408,796 | 4/1995 | Hashimoto et al. | 52/775 X |
| 5,415,301 | 5/1995 | Bruton et al. | 211/183 |
| 5,433,327 | 7/1995 | Benvenuti et al. | 211/187 X |
| 5,579,621 | 12/1996 | Fang | 52/238.1 X |

FOREIGN PATENT DOCUMENTS

| | | | |
|---|---|---|---|
| 2595737 | 9/1987 | France | 52/243.1 |

*Primary Examiner*—Carl D. Friedman
*Assistant Examiner*—Laura A. Saladino
*Attorney, Agent, or Firm*—Bucknam and Archer

[57] ABSTRACT

A partition frame having two parallel side walls, a flat connecting wall perpendicularly connected between the side walls, two longitudinal grooves defined between the two side walls at two opposite sides of the flat connecting wall, longitudinal rows of key holes on the side walls for mounting partition panels, and two longitudinal rows of recessed hanging holes on each side wall at an outer side for hanging things.

3 Claims, 5 Drawing Sheets

PARTITION FRAME STRUCTURE

BACKGROUND OF THE INVENTION

The present invention relates to a partition frame structure for use in setting up partition walls.

When a building is built up, the inside space of each floor may be divided into several rooms subject to different requirements. A variety of methods and materials have been developed for building flexible partition walls. Regular flexible partition walls are commonly made by using modularized unit frames and partition panels. However, conventional methods in setting up flexible partition walls have numerous drawbacks as outlined hereinafter:

1) Noises and pollutions will be produced during the construction work because the parts of the partition walls must be processed and installed at the job site by tools.
2) When a partition wall is set up, gaps commonly exist in between the parts of the frames and the partition panels, therefore it cannot effectively protect against dust and sound.
3) When a high-raised partition wall is set up, it tends to oscillate or deform.
4) Because regular partition panels are commonly made of single color, the construction work becomes complicated if the user needs a colorful design.
5) Only specially trained engineers or workers can do the job.

SUMMARY OF THE INVENTION

The present invention has been accomplished under the circumstances in view. According to one aspect of the present invention, the partition frame comprises two parallel side walls, a flat connecting wall perpendicularly connected between the side walls, two longitudinal grooves defined between the two side walls at two opposite sides of the flat connecting wall, longitudinal rows of key holes on the side walls for mounting partition panels, and two longitudinal rows of recessed hanging holes on each side wall at an outer side for hanging things. According to another aspect of the present invention, sound insulators are adhered to the side walls of the partition frame and covered over the holes therein. The sound insulators are made from plastics or paper. Therefore it is easy to tear holes in the sound insulators during the installation.

DETAILED DESCRIPTION OF THE PREFERRED EMBODIMENTS

Figure 1:
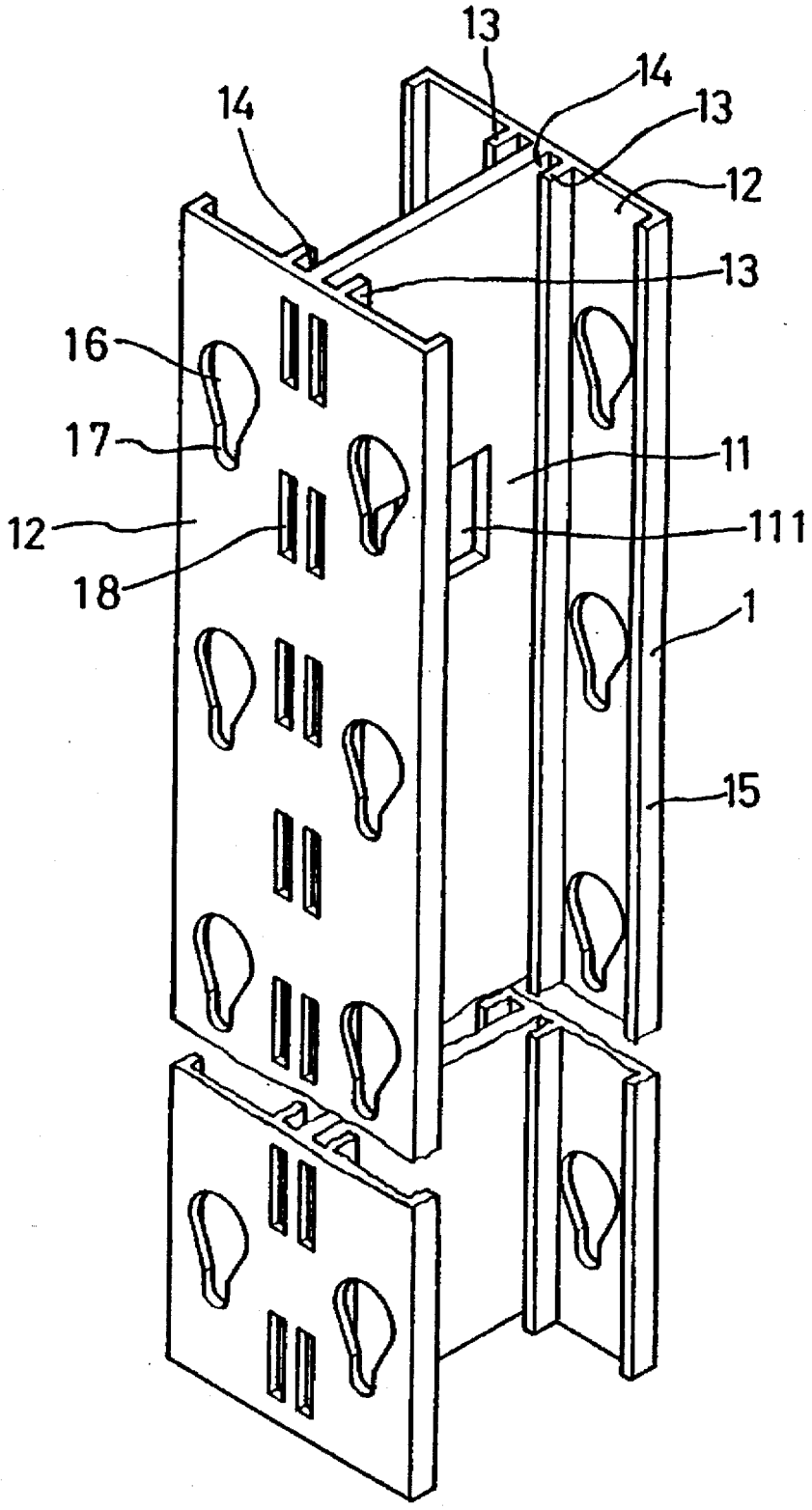
FIG. 1 is an elevational view of a partition frame according to a first embodiment of the present invention.

Referring to FIG. 1, a partition frame 1 in accordance with a first embodiment of the present invention is generally comprised of two parallel side walls 12, and a flat connecting wall 11 perpendicularly connected between the side walls 12, two symmetrical pairs of longitudinal ribs 13 respectively raised from the inside of each side wall 12 and bilaterally disposed in parallel to the flat connecting wall 11 and defining with the flat connecting wall 11 two longitudinal mounting grooves 14 at two opposite sides, two symmetrical pairs of stop flanges 15 respectively raised from two opposite sides of each side wall 12 at right angles in the same direction, longitudinal rows of key holes aligned on each side wall 12, each key hole comprised of a big insertion hole 16 and a small locating hole 17 linked to the big insertion hole 16 at one end, two longitudinal rows of recessed hanging holes 18 on each side wall 12 at an outer side opposite to the longitudinal ribs 13 and a longitudinal row of through holes 111 on the flat connecting wall 11 for mounting supporting rods.

Figure 2:
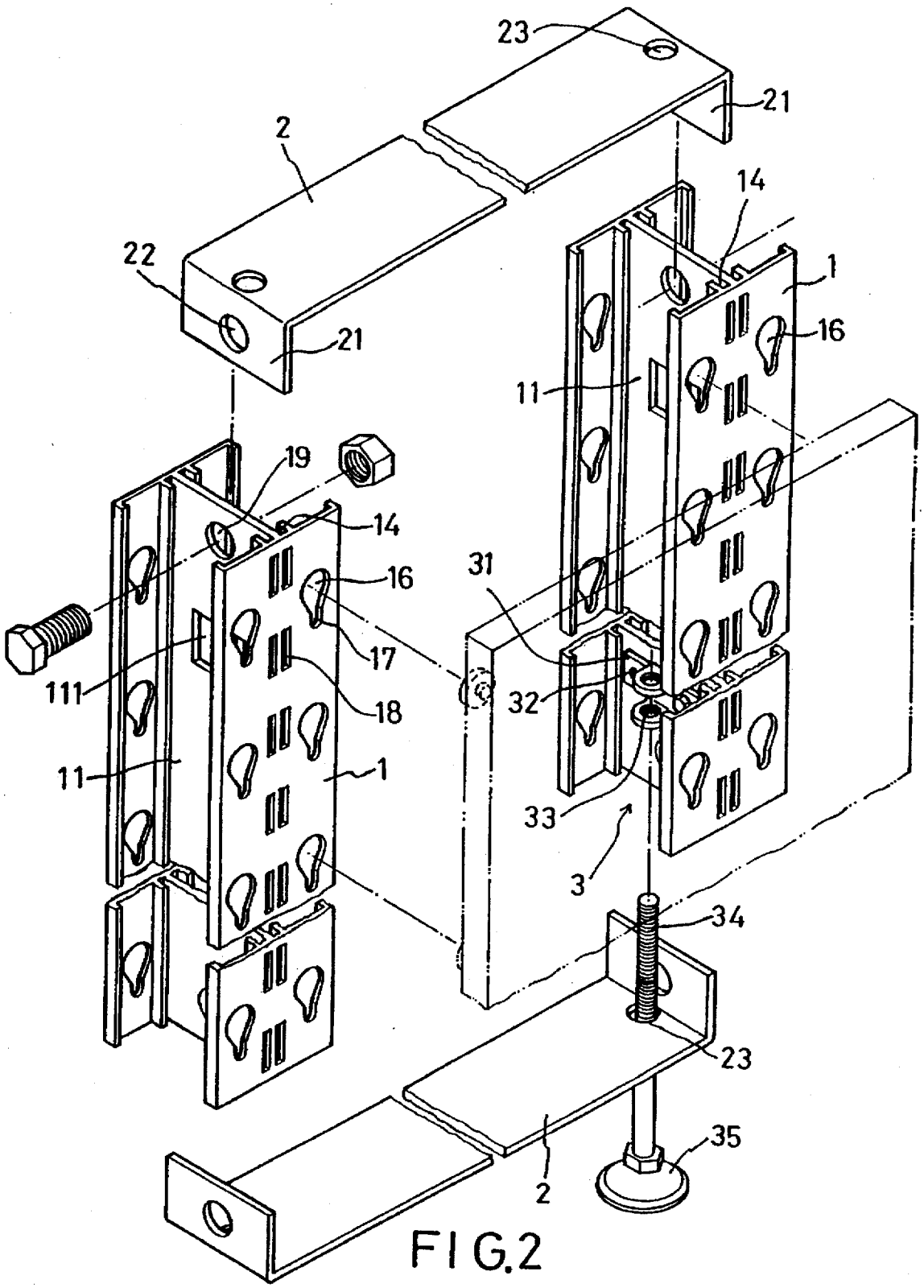
FIG. 2 is an applied view of the partition frame shown FIG. 1.
Figure 3:
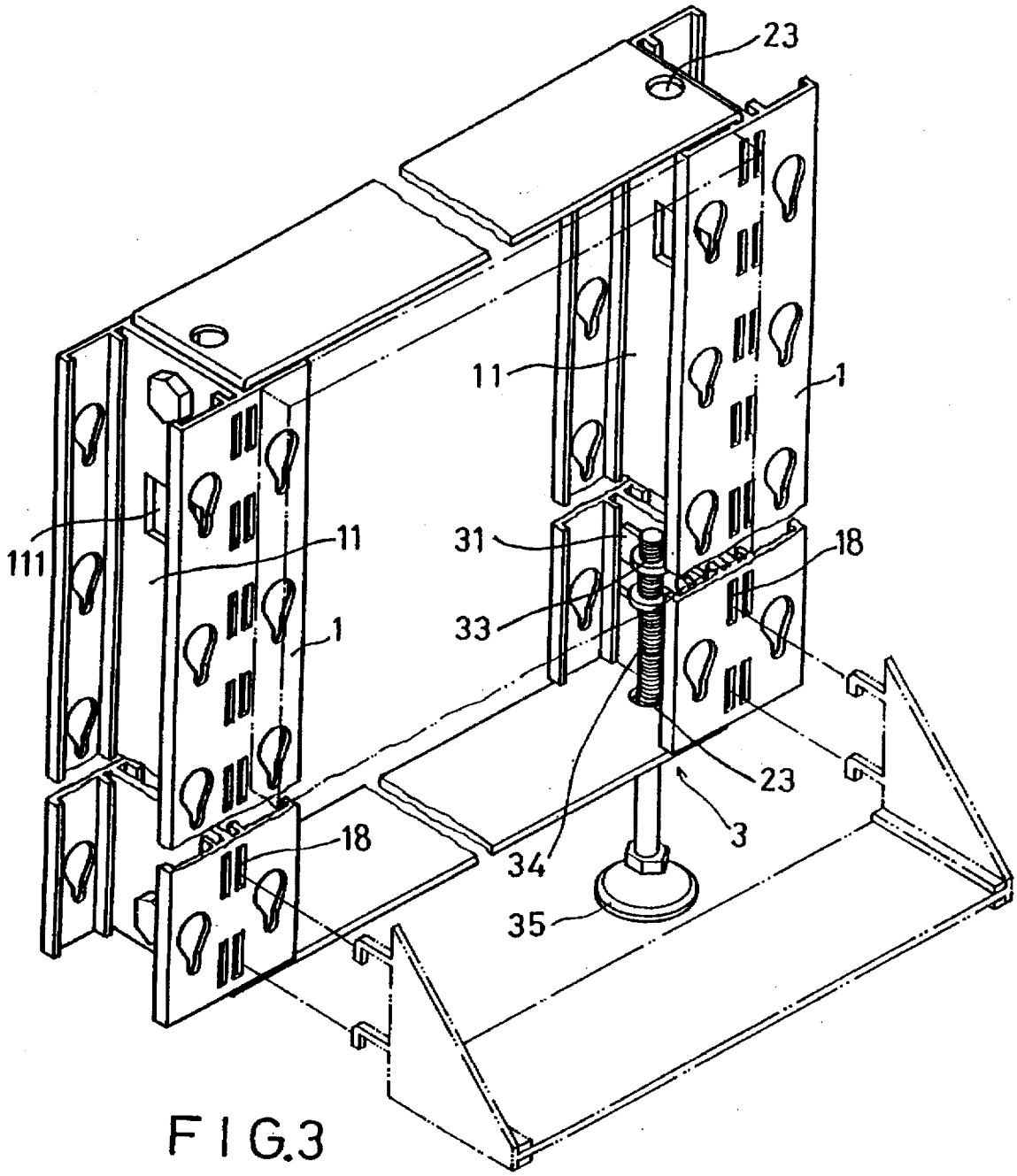
FIG. 3 is an assembly view of FIG. 2.

Referring to FIGS. 2 and 3, two partition frames 1 are connected in parallel by two mounting plates 2. Each mounting plate 2 has two angled flanges 21 at two opposite ends respectively fitted into one longitudinal groove 14 on each partition frame 1, each angled flange 21 having a through hole 22 connected to a respective through hole 19 on one partition frame 1 by a screw bolt. When the partition frames 1 and the mounting plates 2 are connected together, partition panels can then be hung on the partition frames 1 by inserting the respective mounting bolts of the partition panels into the respective big insertion holes 16 and then hanging the mounting bolts on the respective small locating holes 17. When the partition wall is built up, two elevation adjustment devices 3 can be installed in the partition frames 1 at the bottom for adjusting their heights respectively. The elevation adjustment device 3 comprises a mounting frame 31 and an adjustment screw 34. The mounting frame 31 has mounting holes 32 fixedly secured to the flat connecting wall 11 of the respective partition frame 1 by screws, and a screw holder 33 for connection to the adjustment screw 34. The adjustment screw 34 is inserted through a respective through hole 23 on the respective mounting plate 2 and then threaded into the screw holder 33, having a bottom end terminating in a stand 35 supported on the ground.

Figure 4:
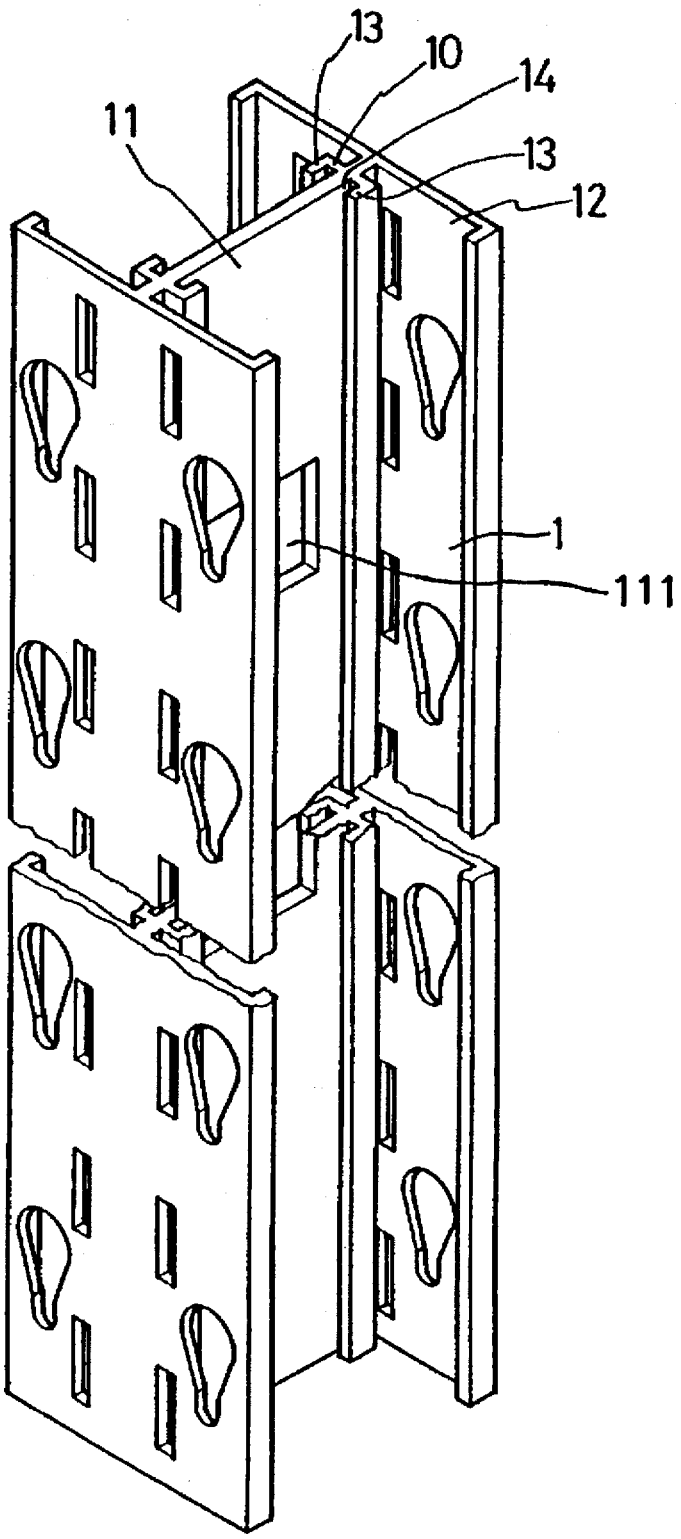
FIG. 4 is an elevational view of a partition frame according to a third embodiment of the present invention.

FIG. 4 shows a partition frame according to a second embodiment of the present invention. This alternate form is similar to that shown in FIG. 1, however the longitudinal ribs 13 in this alternate form are respectively and perpendicularly extended inwards from two opposite pairs of longitudinal rails 10 on two opposite sides of the flat connecting wall 11.

Figure 5:
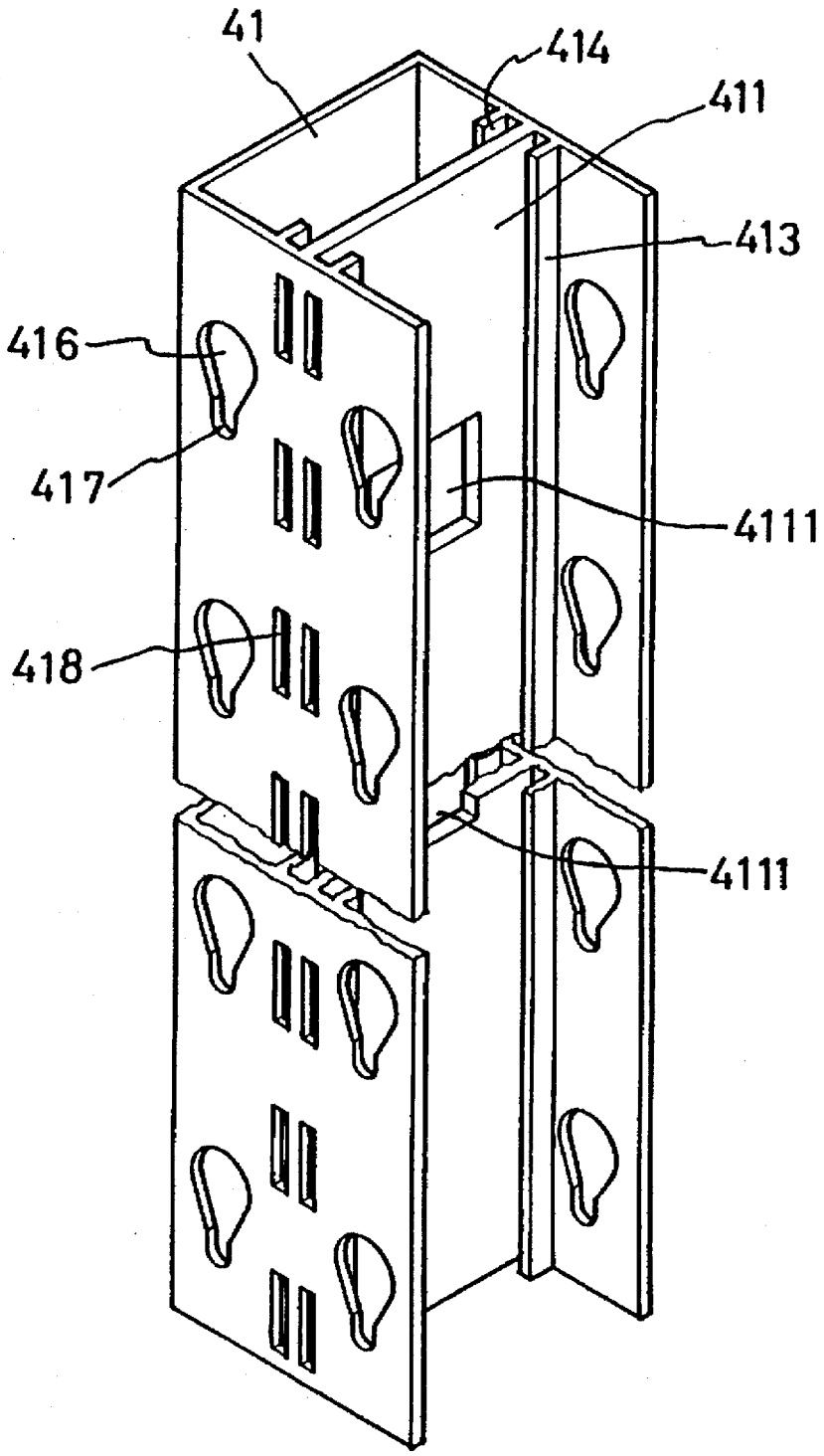
FIG. 5 is an elevated view of a partition frame according to a third embodiment of the present invention.

FIG. 5 shows a partition frame according to a third embodiment of the present invention. According to this alternate form, the partition frame is comprised of a channel bar 41, a flat connecting wall 411 connected between two opposite parallel side walls of the channel bar 41, two symmetrical pairs of longitudinal ribs 413 respectively raised from the inside of of the channel bar 41 and bilaterally disposed in parallel to the flat connecting wall 411 and defining with the flat connecting wall 411 two longitudinal mounting grooves 414 at two opposite sides of the flat connecting wall 411 longitudinal rows of key holes aligned on the two opposite parallel side walls of the channel bar 41, each key hole comprised of a big insertion hole 416 and a small locating hole 417 linked to the big insertion hole 416 at one end, two longitudinal rows of recessed hanging holes 418 on the two opposite parallel side walls of the channel bar 41 opposite to the longitudinal ribs 413, and a longitudinal row of through holes 4111 on the flat connecting wall 411 for mounting supporting rods.

Referring to FIG. 1 again, sound insulators may be covered on the side walls 12 over the holes 16, 17, 18 to isolate sound and to protect against dust. The sound insulators can be in the form of a flat strip respectively fitted into the space between one stop flange 15 and the adjacent longitudinal rib 13. The sound insulators are made from plastics or paper. Therefore, holes can be easily torn in the sound insulators during the construction of the partition wall.

It is to be understood that the drawings are designed for purposes of illustration only, and are not intended as a definition of the limits and scope of the invention disclosed.

I claim:

1. A vertically arranged partition frame comprising two parallel side walls, a flat connecting wall perpendicularly connected between said side walls and having a longitudinal row of through holes for mounting a respective supporting rod, two longitudinal grooves defined between said flat connecting wall and two symmetrical pairs of longitudinal ribs on said side walls, longitudinal rows of key holes on said side wall for mounting partition panels, two longitudinal rows of recessed hanging holes on each side wall at an outer side for hanging things, and each side wall having two longitudinal stop flanges respectively raised from two opposite sides at right angles in parallel to the respective longitudinal ribs, two elongated mounting plates respectively connected to two opposite ends of said partition frame, each mounting plate having an angled flange at its connection end for insertion into the respective longitudinal groove of said partition frame, each angled flange having a through hole connected to a respective through hole on said flat connecting wall by a screw bolt, and each mounting plate extending from said partition frame to a connection with an additional vertically arranged partition frame, and an elevation adjustment device comprising a mounting frame fixedly secured to said flat connecting wall at one end, a screw holder fixedly connected to said mounting frame and defining a screw hole, and an adjustment screw having a screw body threaded into the screw hole on said screw holder and having a head at one end of said screw body for supporting on the ground.

2. The partition frame of claim 1 further comprising a longitudinal back wall disposed in parallel to said flat connecting wall and joined between said side walls at one side.

3. A vertically arranged partition frame comprising two parallel side walls, a flat connecting wall perpendicularly connected between said side walls and having a longitudinal row of through holes for mounting a respective supporting rod, two longitudinal grooves defined between said flat connecting wall and two symmetrical pairs of angled ribs being respectively raised from two opposite sides of said flat connecting wall, longitudinal rows of key holes on said side wall for mounting partition panels two longitudinal rows of recessed hanging holes on each side wall at an outer side for hanging things, and each side wall having two longitudinal stop flanges respectively raised from two opposite sides at right angles in parallel to the respective longitudinal ribs, two elongated mounting plates respectively connected to two opposite ends of said partition frame, each mounting plate having an angled flange at its connection end for insertion into the respective longitudinal groove of said partition frame, each angled flange having a through hole connected to a respective through hole on said flat connecting wall by a screw bolt, and each mounting plate extending from said partition frame to a connection with an additional vertically arranged partition frame, and an elevation adjustment device comprising a mounting frame fixedly secured to said flat connecting wall at one end, a screw holder fixedly connected to said mounting frame and defining a screw hole, and an adjustment screw having a screw body threaded into the screw hole on said screw holder and having a head at one end of said screw body for supporting on the ground.

* * * * *